US012256872B2

(12) United States Patent
Mutch et al.

(10) Patent No.: US 12,256,872 B2
(45) **Date of Patent: *Mar. 25, 2025**

(54) FOLDABLE BATH TUB

(71) Applicant: Helen of Troy Limited, St. Michael (BB)

(72) Inventors: Martin Mutch, New York, NY (US); Elizabeth Kaye Steenwyk, Detroit, MI (US); Sunny Kim, Douglaston, NY (US); Thomas Chia Hanson, New York, NY (US)

(73) Assignee: HELEN OF TROY LIMITED, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 18/208,503

(22) Filed: Jun. 12, 2023

(65) Prior Publication Data

US 2023/0320534 A1 Oct. 12, 2023

Related U.S. Application Data

(63) Continuation of application No. 17/730,655, filed on Apr. 27, 2022, now Pat. No. 11,759,059, which is a (Continued)

(51) Int. Cl.
*A47K 3/06* (2006.01)
*A47K 3/064* (2006.01)

(52) U.S. Cl.
CPC ..... *A47K 3/064* (2013.01)

(58) Field of Classification Search
CPC ..... A47K 3/06; A47K 3/064; A47K 3/034; A47K 3/127; A47K 3/00; A47K 3/024
(Continued)

(56) References Cited

U.S. PATENT DOCUMENTS 573,625 A 12/1896 Ruffner
1,512,068 A 10/1924 Thornburg
(Continued)

FOREIGN PATENT DOCUMENTS

CN 85203611 3/1987
CN 2051086 1/1990
(Continued)

OTHER PUBLICATIONS

International Search Report filed in PCT/US2019/033525 mailed Jan. 9, 2020.

(Continued)

*Primary Examiner* — Charles P. Cheyney
(74) *Attorney, Agent, or Firm* — RANKIN, HILL & CLARK LLP

(57) ABSTRACT

A foldable bath tub includes a base, a rim, and a basin wall disposed between and interconnecting the base and the rim. The bottom wall has an upwardly extending crotch support. The basin wall includes at least one crease. The basin wall is configured to be positioned in one of a folded condition in which the basin wall is folded into itself at the at least one crease an extended condition in which the basin wall is configured to receive an associated child. Where in the extended condition of the basin wall a distance from the base to the at least one crease increases along a length direction of the bath tub from a first end of the bath tub to a second end of the bath tub.

17 Claims, 11 Drawing Sheets

Related U.S. Application Data continuation of application No. 17/387,318, filed on Jul. 28, 2021, now Pat. No. 11,412,897, which is a continuation of application No. 16/412,858, filed on May 15, 2019, now Pat. No. 11,122,938.

(60) Provisional application No. 62/831,878, filed on Apr. 10, 2019.

(58) Field of Classification Search
USPC ..... 4/586, 585, 584, 572.1, 588, 587
See application file for complete search history.

(56) References Cited

U.S. PATENT DOCUMENTS

| | | | | |
|---|---|---|---|---|
| 2,553,377 | A | 5/1951 | Loventhal | |
| 2,804,989 | A | 9/1957 | Mango | |
| 3,319,265 | A | 5/1967 | Losada | |
| 3,827,087 | A | 8/1974 | Cuthbertson | |
| 4,216,552 | A * | 8/1980 | Gurolnick | A47K 3/034 4/584 |
| 5,439,128 | A * | 8/1995 | Fishman | B65D 21/086 206/218 |
| 5,599,063 | A * | 2/1997 | Lister | A47K 3/127 5/655 |
| 5,735,000 | A * | 4/1998 | Pfaeffle | A47K 3/034 4/585 |
| 6,112,339 | A | 9/2000 | Nichols | |
| 6,341,816 | B1 * | 1/2002 | Chen | A47D 13/107 297/DIG. 11 |
| D469,860 | S | 2/2003 | Riemer | |
| 6,543,068 | B1 * | 4/2003 | Penninger | A47K 3/06 4/585 |
| 6,578,209 | B2 | 6/2003 | Lopes | |
| 6,776,379 | B2 | 8/2004 | Sherer | |
| 7,032,259 | B1 * | 4/2006 | Kilion | A47K 3/064 4/594 |
| 7,430,769 | B2 | 10/2008 | Davis | |
| 7,654,402 | B2 | 2/2010 | Kusuma | |
| D612,023 | S * | 3/2010 | Harris | D23/278 |
| 7,979,925 | B2 | 7/2011 | Karbowski | |
| D656,226 | S | 3/2012 | Erli | |
| 8,607,375 | B2 * | 12/2013 | Yeung | A47K 3/06 4/585 |
| 9,055,847 | B1 | 6/2015 | Flannery | |
| 9,545,176 | B1 | 1/2017 | Finell | |
| D813,358 | S * | 3/2018 | Baldelli | A47K 3/034 D23/278 |
| 10,433,679 | B2 | 10/2019 | Kwak | |
| 10,966,576 | B2 * | 4/2021 | Denton | A47K 3/064 |
| 2003/0070219 | A1 * | 4/2003 | Lopes | A47K 3/024 4/572.1 |
| 2009/0126101 | A1 | 5/2009 | Le | |
| 2011/0083261 | A1 | 4/2011 | Goergen | |
| 2013/0198947 | A1 | 8/2013 | Yeung | |
| 2014/0246445 | A1 * | 9/2014 | Lee | A47L 19/04 220/666 |
| 2018/0242793 | A1 | 8/2018 | Kwak | |

FOREIGN PATENT DOCUMENTS

| | | |
|---|---|---|
| CN | 2068371 | 1/1991 |
| CN | 2076391 | 5/1991 |
| CN | 2119179 | 10/1992 |
| CN | 2285618 | 7/1998 |
| CN | 2832016 | 11/2006 |
| CN | 201005582 | 1/2008 |
| CN | 202553721 | 11/2012 |
| CN | 203591207 | 5/2014 |
| CN | 206603707 | 11/2017 |
| GB | 191015396 | 8/1910 |
| GB | 897745 | 5/1962 |
| GB | 2387109 | 10/2003 |
| GB | 2425469 | 11/2006 |
| JP | S55-79291 | 5/1980 |
| JP | 2006296873 | 11/2006 |
| JP | 2008-036036 | 2/2008 |
| KR | 10-1331838 | 11/2013 |
| TW | 342839 | 10/2008 |
| WO | 2004045354 | 6/2004 |
| WO | 2007129883 | 11/2007 |

OTHER PUBLICATIONS https://tomy.com/products/naked, publicly available prior to Apr. 19, 2019.

* cited by examiner

FOLDABLE BATH TUB

The present application is a continuation of U.S. patent Ser. No. 17/730,655, filed Apr. 27, 2022; which is a continuation of U.S. patent Ser. No. 17/387,318, filed Jul. 28, 2021, now U.S. Pat. No. 11,412,897; which is a continuation of U.S. patent Ser. No. 16/412,858, filed May 15, 2019, now U.S. Pat. No. 11,122,938; which claims the benefit of U.S. Prov. Patent Ser. No. 62/831,878, filed Apr. 10, 2019, the disclosures are incorporated herein in their entirety.

BACKGROUND

Very young infants are unable to sit unsupported, and so are typically bathed in a reclined position. Inexpensive plastic bath tubs are popular for this purpose. As children develop the ability to sit up, they often prefer to sit upright for bathing. Some parents then switch to bathing their children in an adult bath tub, although some would prefer to continue to bathe such children in smaller bath tubs. Further, when the bath tub is not in use it can be difficult to find space for storing the bath tub. Therefore, it is also known to provide foldable bath tubs. For example, these foldable bath tubs generally comprise a main body made of flexible material and a foldable supporting frame for supporting the main body. Nevertheless, these known foldable tubs have certain drawbacks.

SUMMARY

In view of the foregoing, a foldable bath tub includes a base, a rim, and a basin wall disposed between and interconnecting the base and the rim. The basin wall includes at least one circumferential crease. The basin wall is configured to be positioned in one of a folded condition in which the basin wall is folded into itself at the at least one circumferential crease and an extended condition in which the basin wall is configured to receive an associated child. When in the extended condition, the basin wall defines opposing lateral sides oriented closer to parallel as compared to perpendicular to a length dimension of the bath tub, a first back rest adjacent a first end of the bath tub along the length dimension and a second back rest adjacent a second end of the bath tub along the length dimension. When in the extended condition, the first back rest extends at a first angle relative to an associated subjacent surface and the second back rest extends at a second larger angle relative to the associated subjacent surface when measured in cross-section taken along the length dimension of the bath tub, and respective ends of the opposing sides of the basin wall nearest to the first end of the bath tub are offset a greater width distance in a direction perpendicular to the length dimension as compared to respective ends of the opposing sides of the basin wall nearest to the second end.

In another example a foldable bath tub includes a base, a rim and a basin wall. The base includes an upwardly extending crotch support having opposed sides. The basin wall is disposed between and interconnects the base and the rim and includes at least one circumferential crease. The basin wall is configured to be positioned in one of a folded condition in which the basin wall is folded into itself at the at least one circumferential crease an extended condition in which the basin wall is configured to receive an associated child. When in the extended condition, each opposed side of the upwardly extending crotch support is spaced from the basin wall in a direction perpendicular to a length dimension of the bath tub.

DETAILED DESCRIPTION

Figure 1:
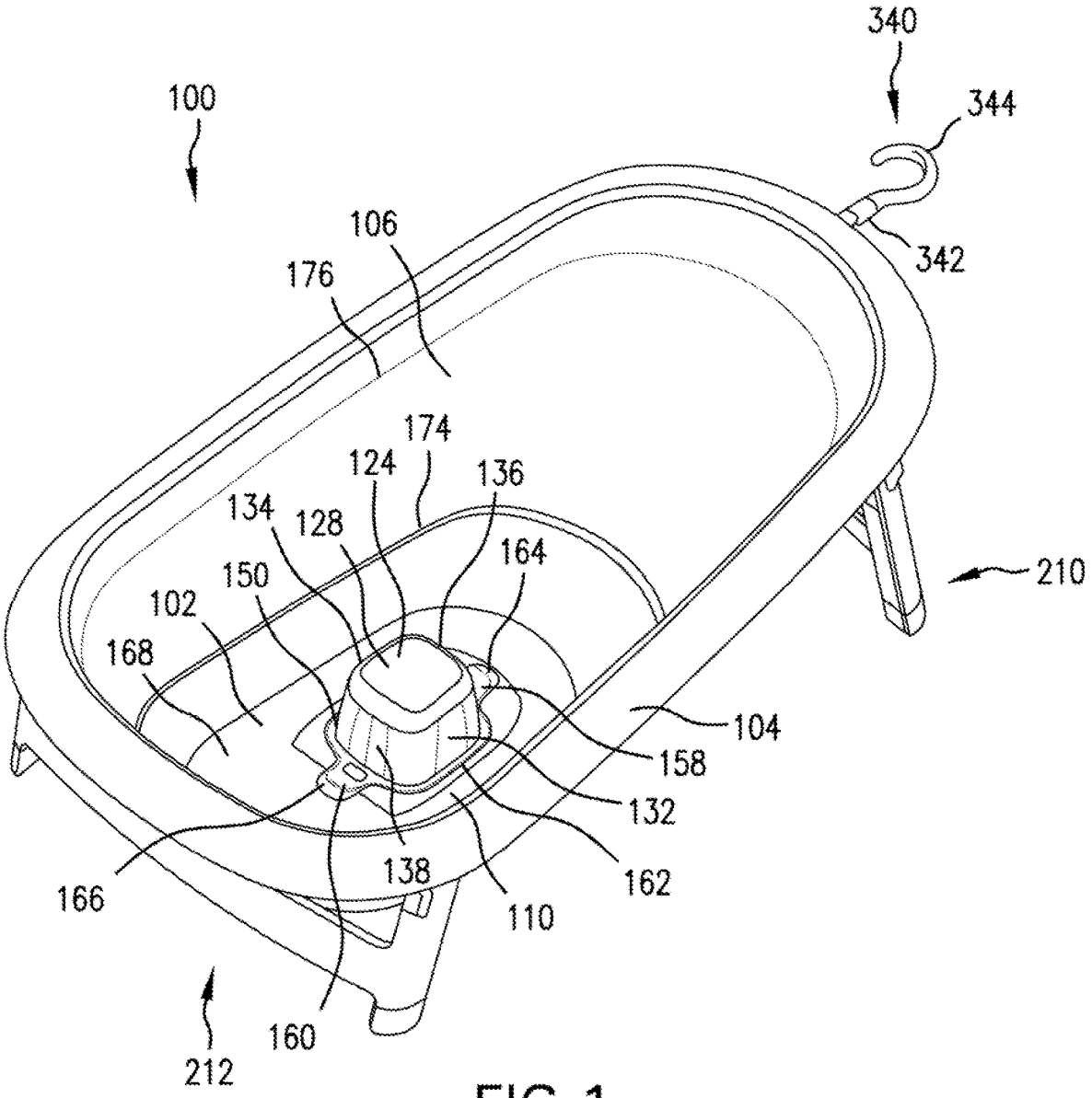
FIG. 1 is a perspective view of a foldable bath tub according to the present disclosure, wherein a basin wall of the bath tub is in an extended condition.
Figure 2:
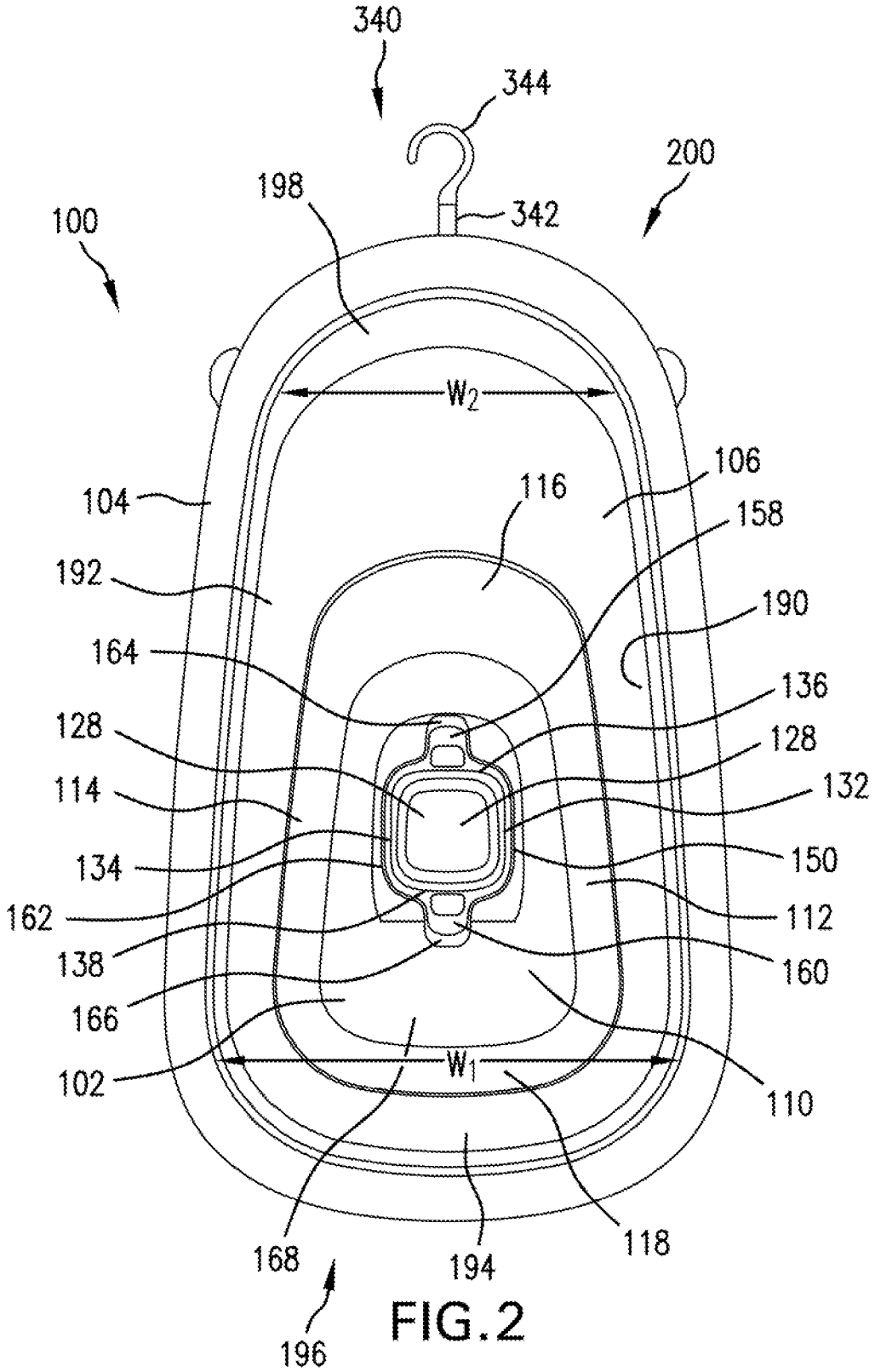
FIG. 2 is a top view of the bath tub of FIG. 1.
Figure 3:
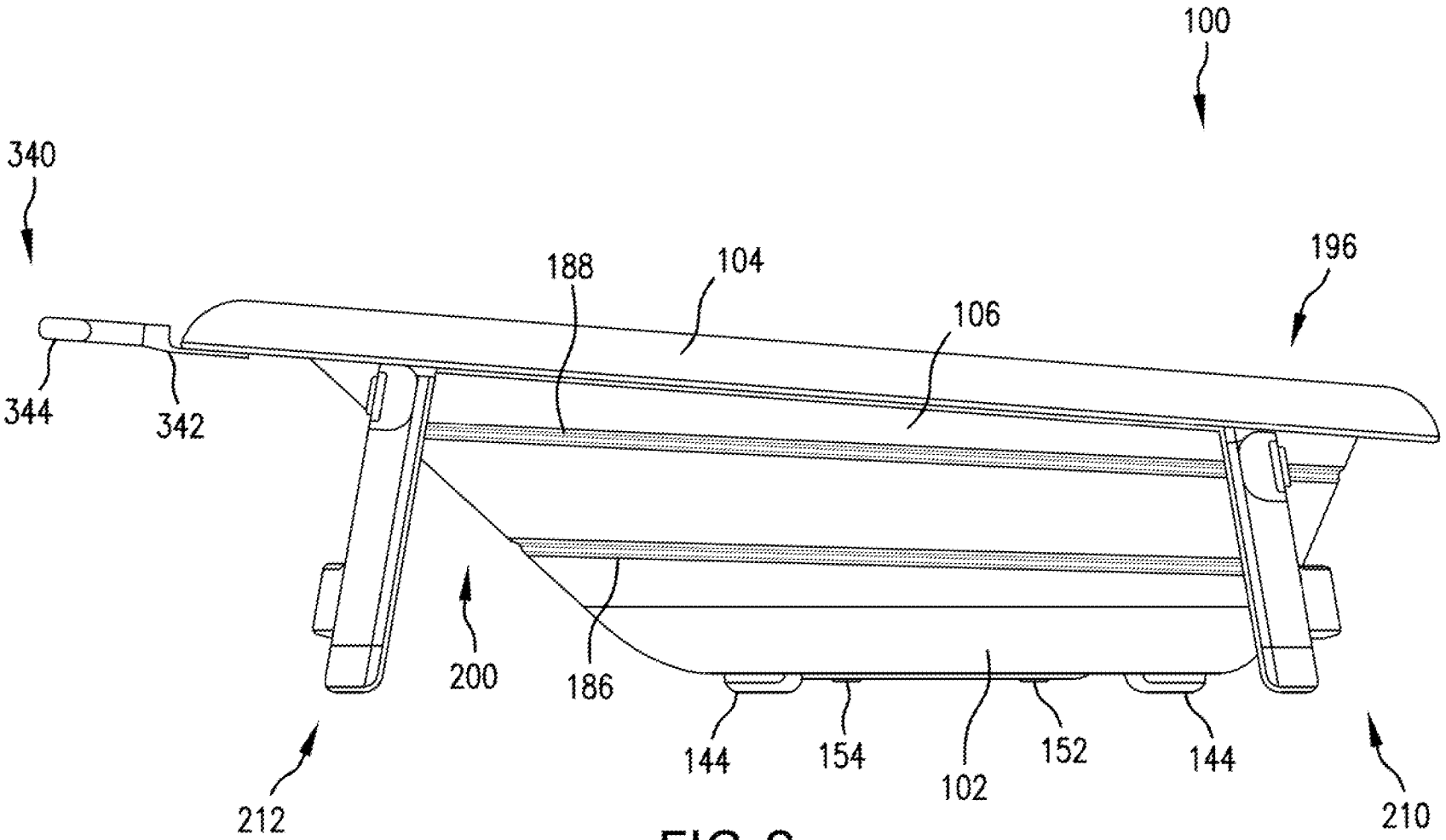
FIG. 3 is a side view of the bath tub of FIG. 1.
Figure 4:
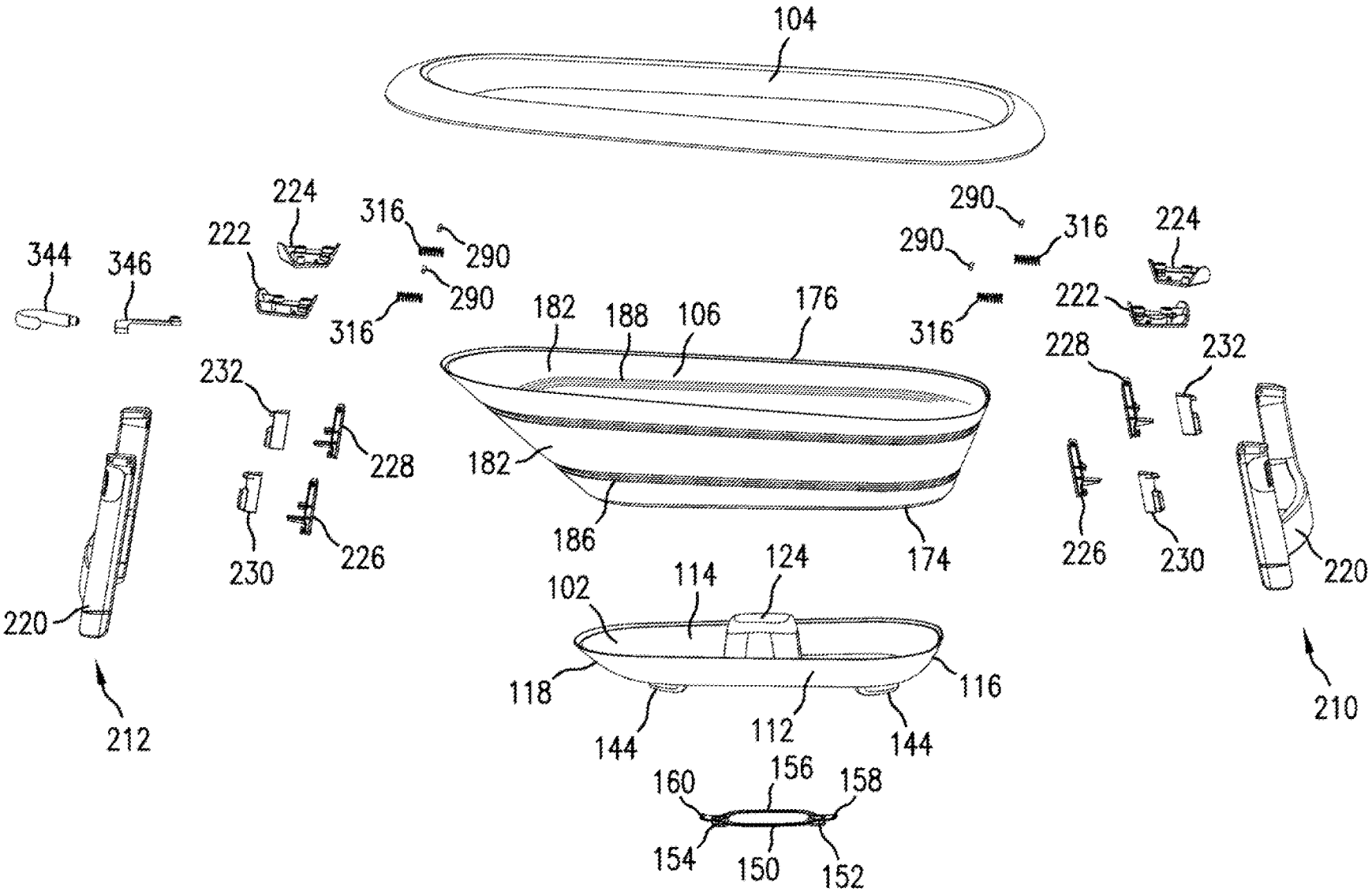
FIG. 4 is an exploded view of the bath tub of FIG. 1.

It should, of course, be understood that the description and drawings herein are merely illustrative and that various modifications and changes can be made in the structures disclosed without departing from the present disclosure. Further, spatially relative terms which describe a relationship between features of the bath tub relate to the bath tub as oriented in FIG. 1. Moreover, any term of degree used herein, such as "substantially" and "approximately", means a reasonable amount of deviation of the modified word is contemplated such that the end result is not significantly changed. For example, such terms can be construed as allowing a deviation of at least 5% of the modified word if this deviation would not negate the meaning of the word the term of degree modifies.

Referring now to the drawings, wherein like numerals refer to like parts throughout the several views, FIGS. 1-5 illustrate a foldable bath tub 100 according to the present disclosure, which is configured for bathing either an infant in a reclined position, or a toddler in an upright, seated position. The bath tub 100 generally comprises a base 102, a rim 104 and an annular basin wall 106 disposed between and interconnecting the base and the rim. The basin wall 106 is configured to be positioned in one of an extended condition and a folded condition (i.e., the basin wall 106 is foldable between the base 102 and the rim 104).

The depicted base 102 includes a bottom wall 110, opposed sidewalls 112, 114, and opposed end walls 116, 118 which are integral with the sidewalls. The sidewalls and the end walls can extend obliquely upwardly from the bottom wall 110. The bottom wall 110 has an upwardly extending center post or crotch support 124. The crotch support 124 is defined by a top wall 128, opposed sides 132, 134, which are spaced inwardly from the sidewalls 112, 114, and opposed ends 136, 138, which are spaced inwardly from the end walls 116, 118. With the basin wall 106 in the extended condition, each opposed side 132, 134 of the upwardly extending crotch support 124 is spaced from the basin wall 106 in a direction perpendicular to a length dimension of the bath tub 100 so as to accommodate a child's leg therebetween.

Further provided on the bottom wall 110 are first and second drain holes 140, 142 located inwardly of support feet 144 that depend from the bottom wall 110. According to one aspect, the first drain hole 140 is located at the end 136 of the crotch support 124 and the second drain hole 142 is located at the other end 138 of the crotch support. By having the first and second drain holes 140, 142 located on opposite ends 136, 138 of the crotch support 124, the user can selectively drain the bath tub 100 when in use by either an infant or a toddler without having to first move the infant or toddler in the bath tub.

The bath tub 100 further includes a drain plug 150 adapted to seal the first and second drain holes 140, 142. The features of the drain plug 150 are best shown in FIG. 6. In the depicted embodiment, the drain plug 150 is a one-piece, unitary component configured to be fitted over the crotch support 124. The drain plug 150 has a first plug 152 for insertion in the first drain hole 140 and a second plug 154 for insertion in the second drain hole 142. The first and second plugs 152, 154 are connected via a ring-shaped mount 156 and depend from first and second pull tabs 158, 160 which project from the mount 156. The pull tabs allow for ease of removal of the drain plugs from the drain holes. To secure the drain plug 150 to the base 102, the mount 156 is fitted over or around the crotch support 124. The bottom wall 110 of the base 102 includes a groove 162 surrounding the crotch support 124 and first and second recessed portions 164, 166 extending from the groove 162. The groove 162 is sized to receive the mount 156 and the first and second recessed portions 164, 166 are sized to receive the first and second pull tabs 158, 160. When fitted into the groove 162 and the first and second recessed portions 164, 166, the drain plug 150 is substantially flush with an interior surface 168 of the bottom wall 110 (see FIG. 5).

Figure 12:
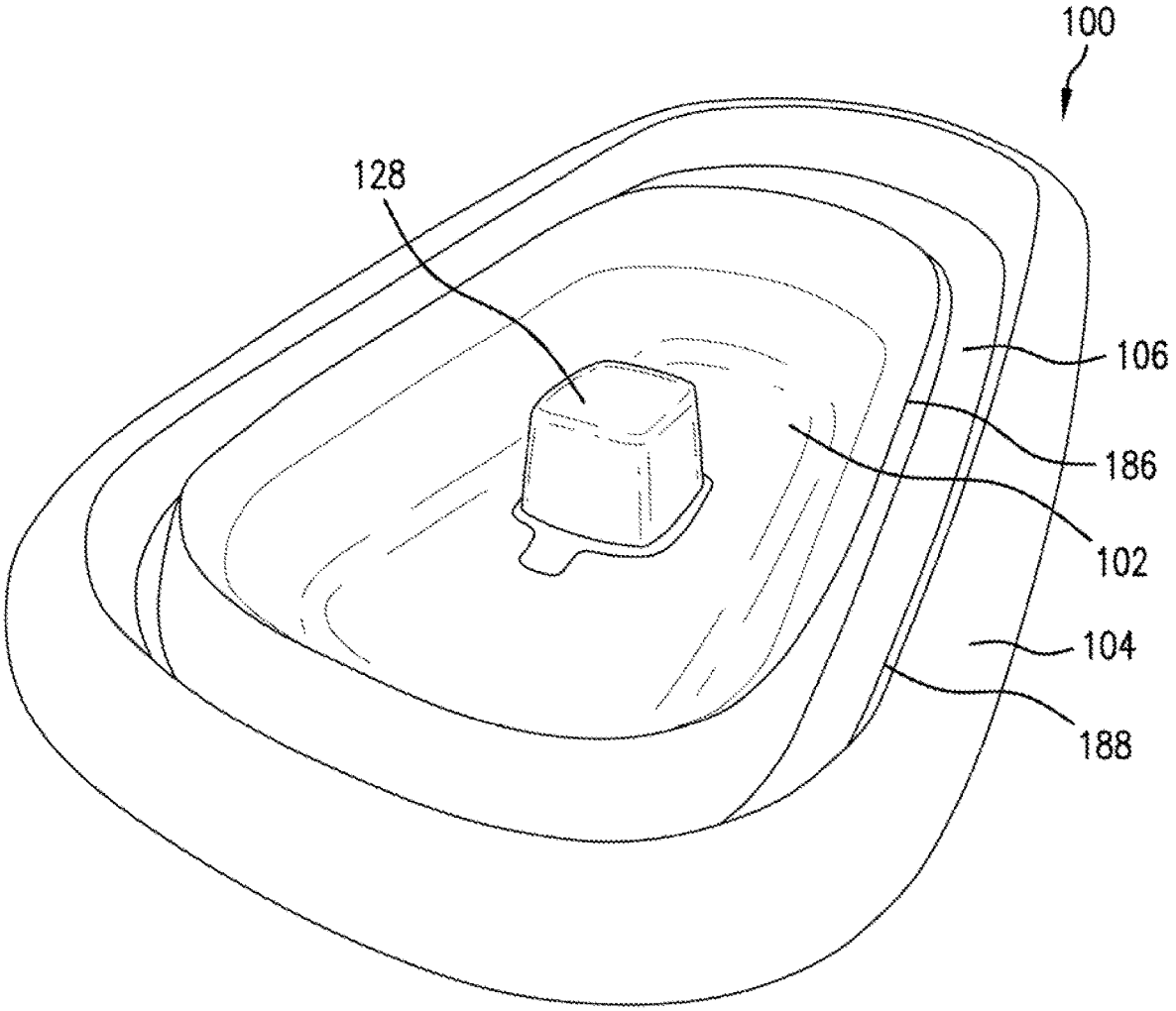
FIG. 12 is a top perspective view of the of the bath tub of FIG. 1 with the basin wall in a folded condition.
Figure 13:
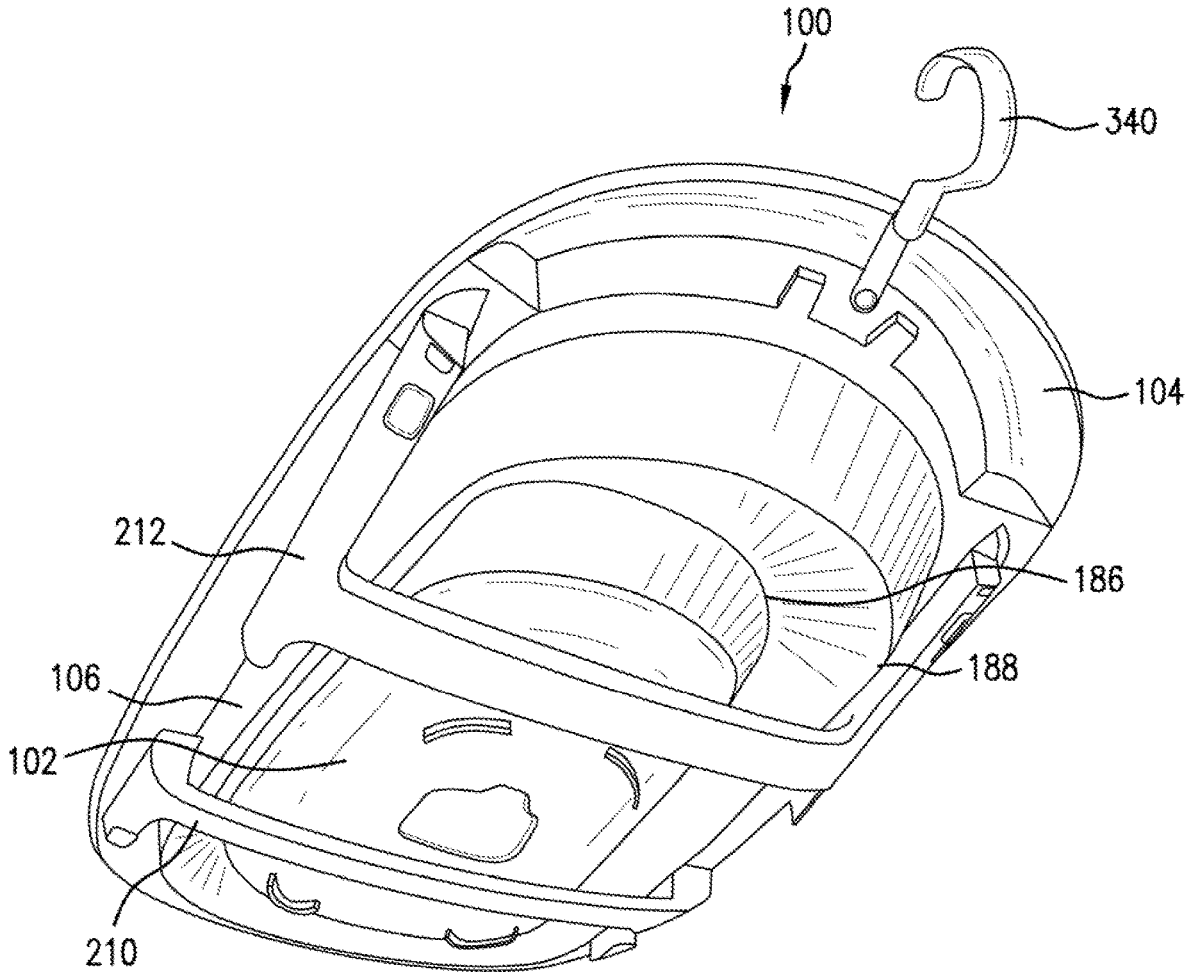
FIG. 13 is a bottom perspective view of the of the bath tub of FIG. 1 with the basin wall in the folded condition.

With continued reference to FIGS. 1-5, the basin wall 106 includes a first edge portion 174 secured to the base 102 and a second edge portion 176 secured to the rim 104. The basin wall 106 further includes an inner surface 180 and an outer surface 182. The outer surface 182 is formed with at least one circumferential crease 186 having a reduced thickness, thereby allowing the basin wall 106 to fold into itself at the at least one crease 186 when in the folded condition. In the depicted embodiment, the at least one crease 186 is a first circumferential crease and the outer surface 182 of the basin wall 106 is formed with a second circumferential crease 188 also having a reduced thickness. The first and second creases 186, 188 extend approximately parallel to one another around the basin wall 106 and are spaced inwardly from the respective first and second edge portions 174, 176 with the first crease 186 located closer to the base 102 than the second crease 184 in a height direction of the bath tub. As shown in FIGS. 12 and 13, the basin wall 106 is foldable along the first and second creases 186, 188, and in the folded condition of the basin wall 106 the first crease 186 is located closer to the rim 104 than the second crease 188 in the height direction of the bath tub.

When in the extended condition and with reference to FIG. 1, the basin wall 106 defines opposing lateral sides 190, 192, a first back rest 194 adjacent a first end 196 of the bath tub 100 along a length dimension of the bath tub 100 and a second back rest 198 adjacent a second end 200 of the bath tub 100 along the length dimension. In plan view (see FIG. 2), the opposing lateral sides 190, 192 are oriented closer to parallel as compared to perpendicular to a length dimension of the of the bath tub 100. Although the opposing lateral sides 190, 192 are shown as linear and converging toward the length dimension from the first end 196 toward the second end 200 in plan view, the opposing lateral sides 190, 192 can take other configurations, such as being more curved. The first back rest 194 and the second back rest 198 are disposed closer to perpendicular as compared to parallel to the length dimension of the of the bath tub 100.

Figure 5:
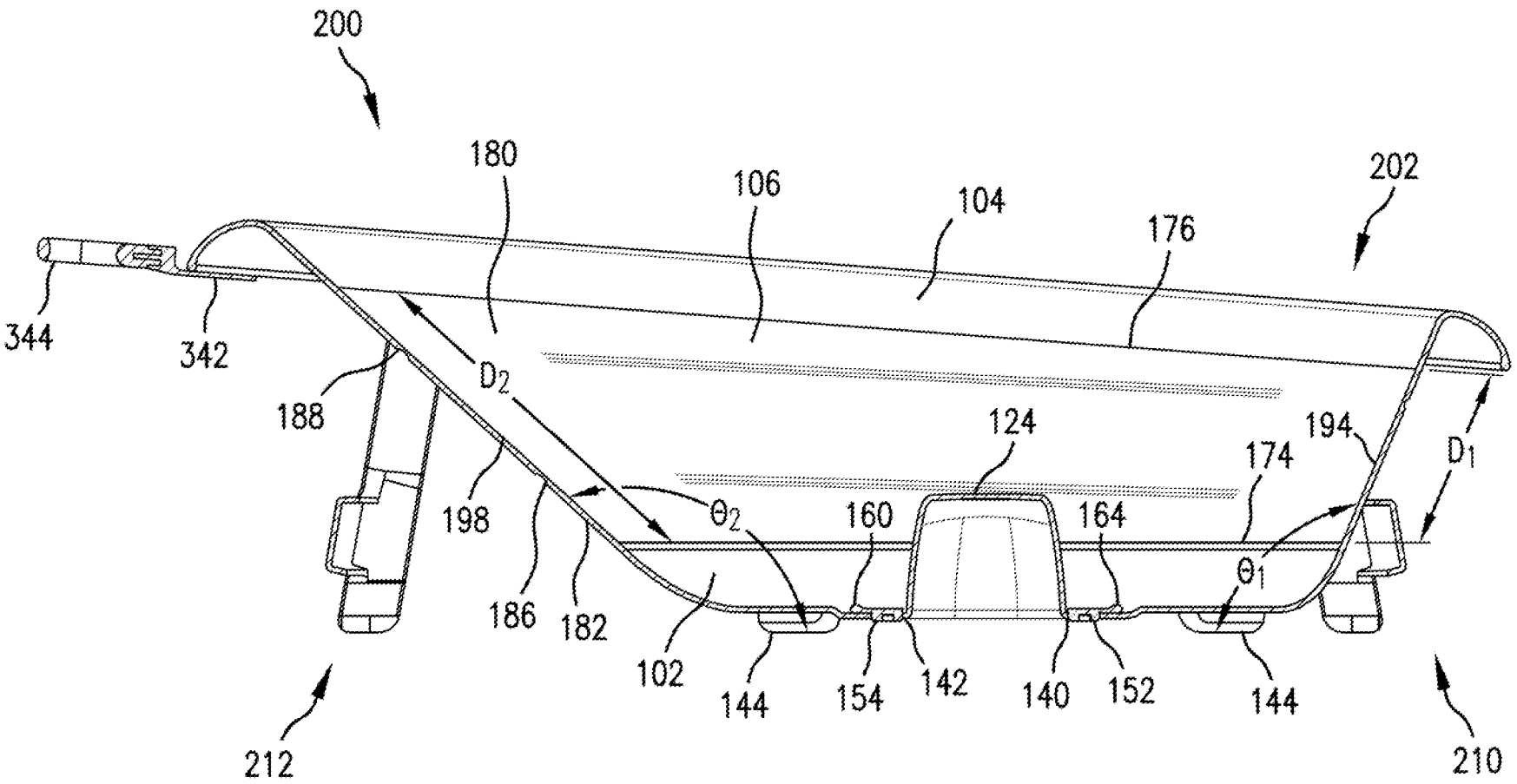
FIG. 5 is a cross-sectional view taken along a length dimension of the bath tub of FIG. 1.
Figure 6:
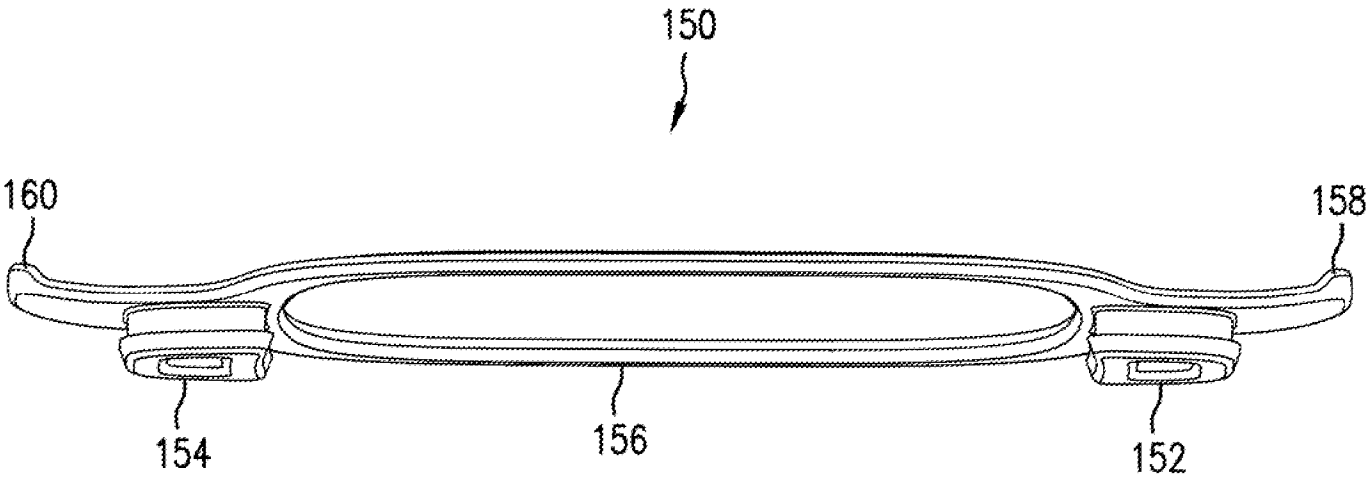
FIG. 6 is a perspective view of a drain plug of the bath tub of FIG. 1.
Figure 7:
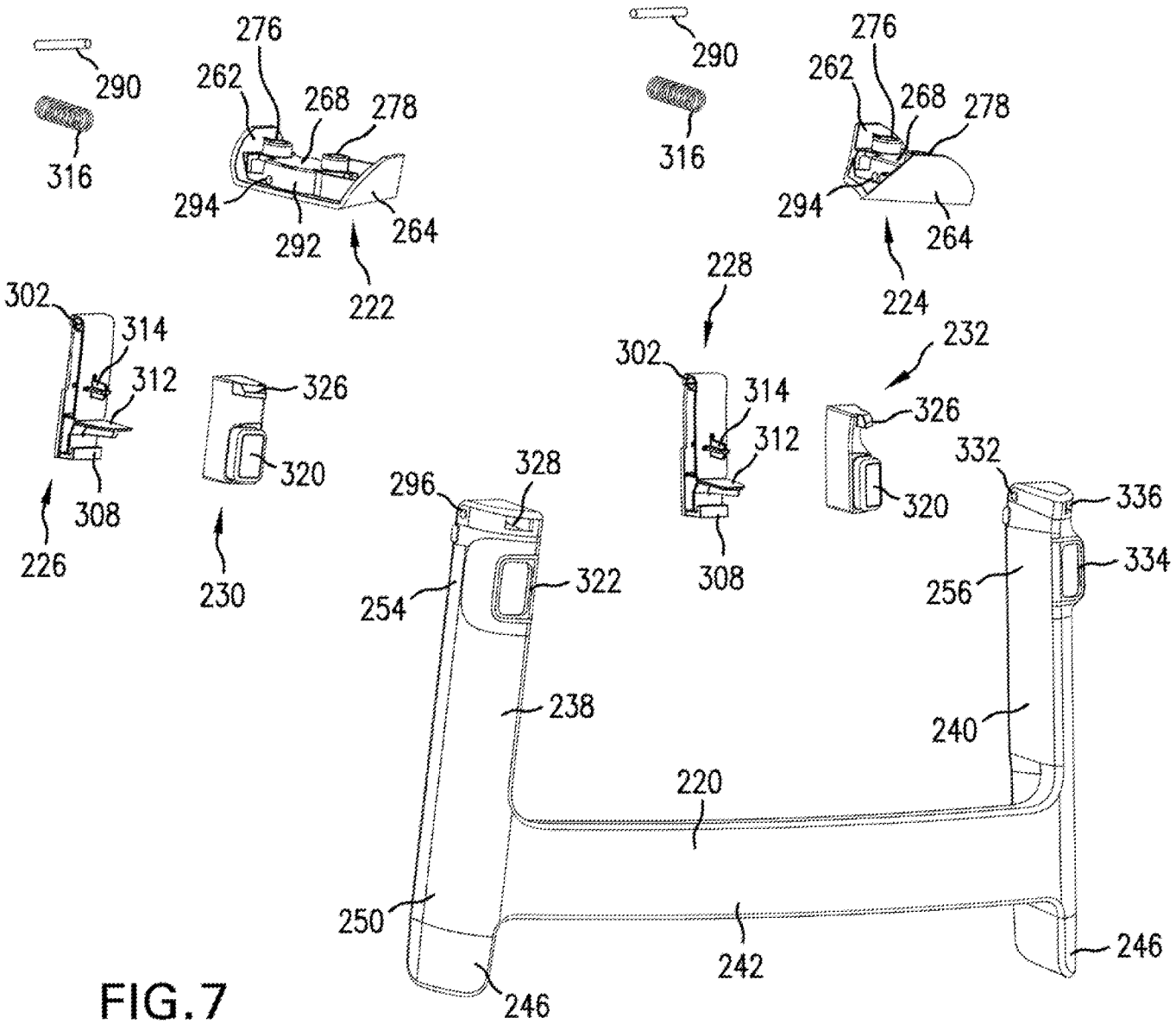
FIG. 7 is an exploded view of a support for the bath tub of FIG. 1.
Figure 8:
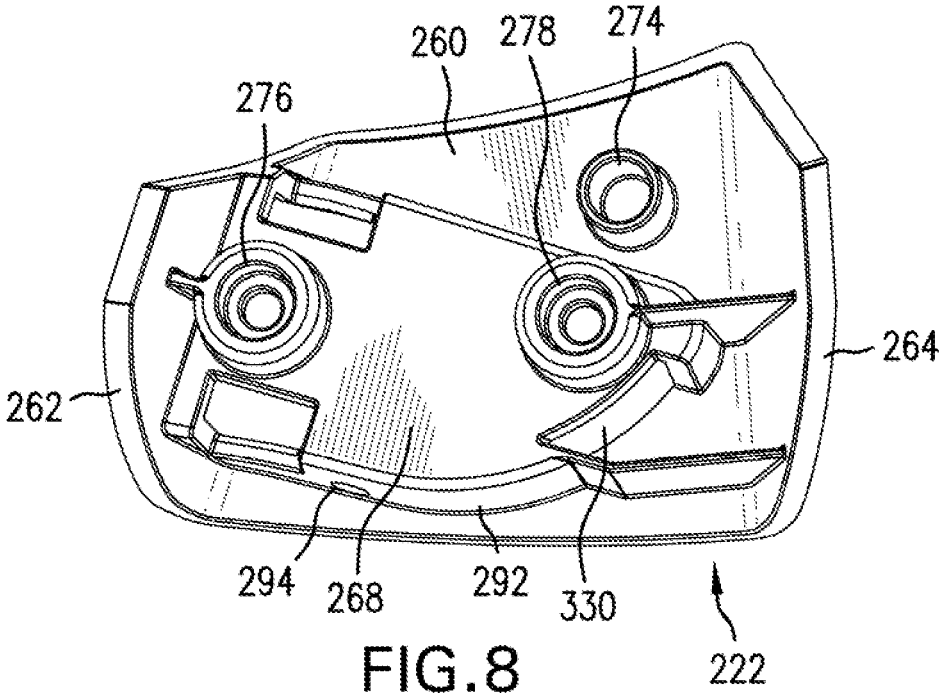
FIGS. 8 and 9 are perspective views of mounts of the support of FIG. 7.
Figure 9:
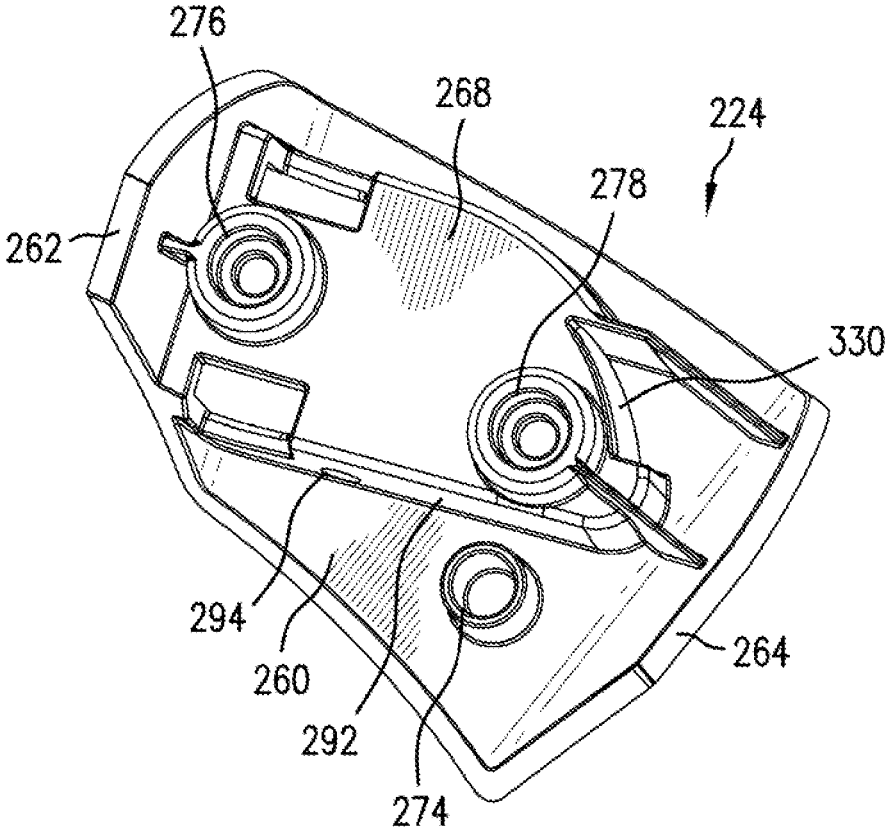

With reference to FIG. 5, when the basin wall 106 is in the extended condition, the first back rest 194 extends at a first angle θ1 relative to an associated subjacent surface supporting the bath tub 100 and the second back rest 198 extends at a second larger angle θ2 relative to the associated subjacent surface when measured in cross-section taken along the length dimension of the bath tub 100. This configuration allows an infant to be more reclined with respect to horizontal (when the associated subjacent surface is horizontal) when resting against the second back rest 198, and a toddler to be more upright with respect to horizontal when resting against the first back rest 194. With reference back to FIG. 2, respective ends of the opposing sides 190, 192 of the basin wall 106 nearest to the first end 196 of the bath tub 100 are offset a greater width distance W1 in a direction perpendicular to the length dimension as compared to respective ends of the opposing sides 190, 192 of the basin wall 106 nearest to the second end 200, e.g. width distance W2 in FIG. 2. As such, as the child grows and is able to sit more upright in the bath tub 100, the greater width distance W1 is able to accommodate the child.

In the extended condition and at the first end 196 of the bath tub 100 the inner surface 180 of the basin wall 106 in a cross-section taken along the length dimension of the bath tub 100 extends continuously (and without interruption by the at least one crease) a first distance D1 from the base 102 to the rim 104. Further depicted, at a second end 200 of the bath tub 100 the inner surface 180 of the basin wall 106 in the cross-section extends continuously (and without interruption by the at least one crease) a second distance D2 from the base 102 to the rim 104. The bath tub 100 is configured such that the first distance D1 differs from the second distance D2, i.e., D1<D2. As illustrated, in the extended condition and at the first end 196 of the bath tub 100 the inner surface 180 of the basin wall 106 in the cross-section can define a continuous, approximately straight first line (coincident with the first back rest 194 in FIG. 5) extending from the base 102 to the rim 104, and at the second end 200 of the bath tub 100 the inner surface 180 of the basin wall 106 in the cross-section can define a continuous, approximately straight second line (coincident with the second back rest 198 in FIG. 5) extending from the base to the rim. The bath tub 100 is configured such that a length dimension of the first line differs from a length dimension of the second line.

Because of the differing dimensions/lengths and angles defined by the inner surface 180 of the basin wall 106 in the cross-section, in the extended condition a distance from the base 102 to at least one of the first crease 186 and the second crease 188 continuously increases from the first end 196 of the bath tub 100 to the second end 202 of the bath tub 100. In the depicted embodiment, the bath tub 100 is configured such that a distance from the base 102 to each of the first crease 186 and the second crease 188 continuously increases from the first end of the bath tub to the second end of the bath tub. By having the first and second creases 186, 188 angled on the basin wall 106 relative to the base 102, in the folded condition of the basin wall 106 the bath tub 100 can have a substantially constant height dimension from the first end 196 to the second end 202 (see FIG. 12). This allows for ease of storage of the bath tub 100.

The bath tub 100 further includes a first support 210 and a second support 212 each pivotally connected to the rim 104 for supporting the bath tub 100 on the associated subjacent surface. The first support 210 is located at the first end 196 of the bath tub 100 and the second support is located at the second end 202 of the bath tub. The first and second supports 210, 212 may be identically constructed, but for their disposition on the opposite ends of the bath tub 100. To simplify the explanation of the present disclosure, only the first support 210 will be discussed, but using the same reference numerals for the features of the first and second supports 210, 212. With particular reference to FIGS. 7-11, the first support 210 comprises a leg member 220, mounts 222, 224 for attaching the leg member 220 to the rim 104, backing member 226, 228 secured to the respective mounts 222, 224, and engaging members 230, 232 movably supported on the respective backing member 226, 228 and configured to releasably engage the respective mount 222, 224. The leg member 220 has first and second uprights 238, 240 and a transverse member 242 interconnecting the first and second uprights. Feet 246, which can be made of a rubber material, are secured to lower end portions 250, 252 of the first and second uprights. The upper end portions 254, 256 of the first and second uprights 238, 240 are pivotally connected to the respective mounts 222, 224.

Because the mounts 222, 224, backing member 226, 228, and engaging members 230, 232 are provided on the opposite sides of the first support 210 in left-right symmetry, the following describe in detail only the left-side component members as shown in FIG. 6, using the same reference numerals for the left and right component members. The mount 222 includes a base wall 260 and end walls 262, 264. A platform 268 is provided on the base wall 260 and merges into the end wall 262. The platform 268 defines a cavity (not shown) which extends through the end wall 262, the cavity sized to receive the upper end portion 254 of the first upright 238. As shown, a first mounting boss 274 is provided on the base wall 260 and second and third mounting bosses 276, 278 are provided on the platform 268. The first mounting boss 274 is received in a corresponding first boss (not shown) on an underside of the rim 104 which properly positions the mount 222. The second and third mounting bosses 276, 278 receive and are fastened to corresponding second and third bosses (not shown) also on the underside of the rim 104. The upper end portion 254 of the first upright 238 is pivotally connected to the mount 222 via a pivot pin 290. The pivot pin 290 extends through openings in a sidewall 292 of the platform 268 (only opening 294 is visible) and through corresponding openings in the upper end portion 254 of the first upright 238 (only opening 296 is visible).

Figure 11:
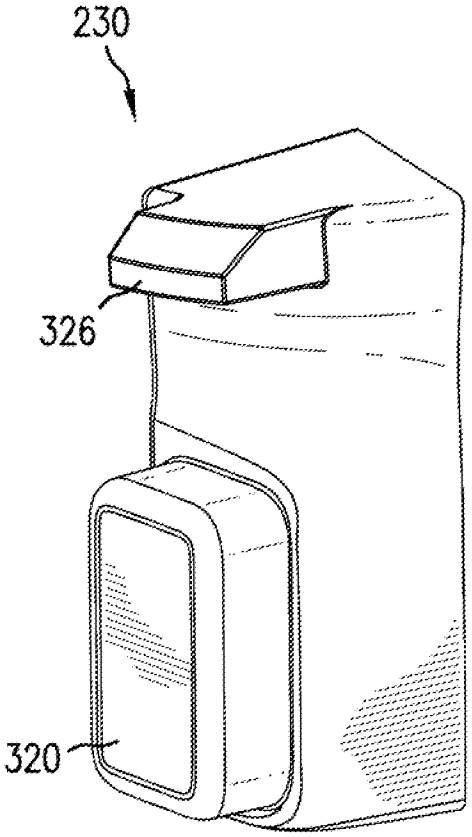
FIG. 11 is a perspective view of a button of the support of FIG. 7.
Figure 10:
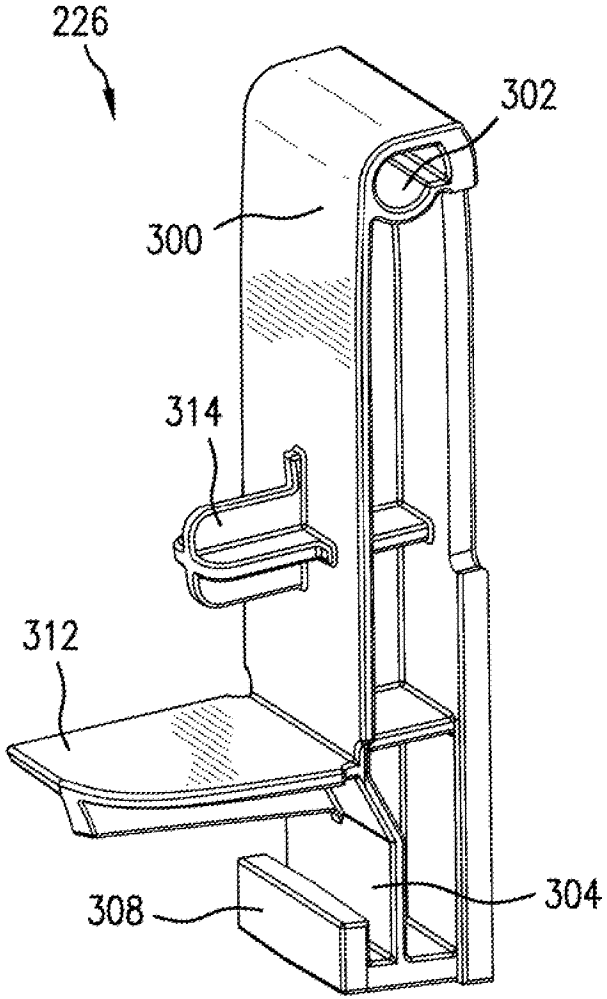
FIG. 10 is a perspective view of a backing of the support of FIG. 7.

The backing member 226 is mounted in the upper end portion 254 of the first upright 238. In the depicted aspect of FIG. 10, the backing member includes a first end portion 300 having a bore 302 for receiving the pivot pin 290 and a second end portion 304 having a mounting flange 308 for engaging an inner mounting flange (not shown) of the upper end portion 254. A seat 312 and a post 314 extend from the backing member 226. The seat 312 at least partially supports the engaging member 230 in the upper end portion 254 of the first upright 238. A spring 316 is mounted on both the post 314 and a corresponding post (not shown) of the engaging member 230. As best shown in FIG. 11, the engaging member 230 includes a button part 320 which is movably received in a first opening 322 in the upper end portion 254. A locking tab 326 located at an end portion of the engaging member 230 is movably received in a second opening 328 in the upper end portion 254 of the first upright 238. The locking tab 326 is further selectively received in a slot 330 located in the sidewall 292 of the platform 268. As depicted, the upper end portion 256 of the second upright 240 includes openings for the pivot pin 290 (only opening 332 is visible) and first and second openings 334, 336 for the respective button part 320 and locking tab 326 of the engaging member 232. In a locked state of the first support 210 the locking tab 326 projects through the slot 330 and engages the base wall 260 of the mount 222. To unlock the first support 210, the button part 320 is pressed which moves the locking tab 326 out of the slot 330 allowing the first support 210 to pivot to a folded state (FIG. 13).

With reference again to FIGS. 1-5, the bath tub 100 further includes a hook 340 connected to the rim 104. According to the present embodiment, the hook 340 is movable about both a first axis and a second axis oriented substantially perpendicular to the first axis. More particularly, the hook 340 includes a mounting part 342 and a separate hook part 344. A connection of the mounting part 342 to the rim 104 defines the first axis and a connection of the hook part 344 to the mounting part 342 defines the second axis. It should be appreciated that the mounting part 342 is movable about the first axis between an extended position where the hook part 344 projects outwardly from the rim 104 and a stowed position where the hook part 344 is covered by the rim. The hook part 344 is rotatable about the second axis relative to the mounting part 342.

According to the present disclosure, an exemplary method of manufacturing a foldable bath tub 100 comprises forming both a base 102 and a rim 104 of the bath tub by a common one-shot injection molding process and connecting the base 102 to the rim 104 with a foldable basin wall 106. The connecting step includes forming the basin wall 106 by a second one-shot injection molding process so that opposite edge portions 174, 176 of basin wall 106 are overmolded onto the previously molded base 102 and rim 104. The base and the rim are made of a first plastic material, and the basin wall is made of a second plastic material.

The method further includes forming the basin wall 106 with at least one circumferential crease having a reduced thickness allowing the basin wall to fold into itself at the at least one crease when in a folded condition. As indicated above, the at least one crease includes first and second circumferential creases 186, 188 each having a reduced thickness. The method includes spacing the first and second creases 186, 188 inwardly from the respective edge portions 174, 176 of the basin wall 106 with the first crease 186 located closer to the base 102 than the second crease 188 in a height direction of the bath tub allowing the first crease 186 to be located closer to the rim 104 than the second crease 188 in the folded condition of the basin wall 106.

Further, in the extended condition of the basin wall 106 and at the first end 196 of the bath tub the inner surface 180 of the basin wall in cross-section taken along a length dimension of the bath tub extends a first distance from the base 102 to the rim 104, and at the second end 200 of the bath tub the inner surface 180 of the basin wall in the cross-section of the bath tub extends a second distance from the base to the rim. The exemplary method includes forming the basin wall such that the first distance differs from the second distance and the at least one crease is canted relative to the base 102. This allows the bath tub 100 to have different seating surfaces at the first and second ends 196, 200 and to have a substantially constant height dimension from the first end 196 to the second end 200 in the folded condition of the basin wall.

It will be appreciated that the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A foldable bath tub comprising:

a base;

a rim;

a basin wall disposed between and interconnecting the base and the rim, the basin wall configured to be positioned in one of a folded condition in which the basin wall is folded into itself and an extended condition in which the bath tub is configured to receive an associated child, the basin wall including first and second creases each having a reduced thickness allowing the basin wall to fold into itself at each of the first and second creases when in the folded condition, when in the extended condition, the basin wall defines a first back rest adjacent a first end of the bath tub along a length dimension of the bath tub and a second back rest adjacent a second end of the bath tub along the length dimension, when in the extended condition, the first back rest extends at a first angle relative to an associated subjacent surface supporting the bath tub and the second back rest extends at a second, larger, angle relative to the associated subjacent surface when measured in cross-section taken along the length dimension of the bath tub, when in the extended condition, at the first end of the bath tub an inner surface of the basin wall in the cross-section taken along the length dimension of the bath tub extends a first distance from the base to the rim and at the second end of the bath tub the inner surface of the basin wall in the cross-section taken along the length dimension of the bath tub extends a second greater distance from the base to the rim, when in the extended condition, opposing sides of the basin wall nearest to the first end of the bath tub are offset a greater width distance in a direction perpendicular to the length dimension as compared to the opposing sides of the basin wall nearest to the second end, when in the extended condition, the first and second creases extend circumferentially around the basin wall, and a distance from at least one of the base and the associated subjacent surface to at least a portion of at least one of the first crease and the second crease in a height direction that is perpendicular to the length direction of the bath tub increases along the length direction from the first end of the bath tub to the second end of the bath tub, when in the extended condition, the first and second creases extend approximately parallel to one another around the basin wall; and a support assembly for supporting the bath tub on the associated subjacent surface, the support assembly including:

a leg member pivotally connected to the rim, and an engaging member including a locking tab movably received in an opening in the leg member, the engaging member is movable is between a locked state where the locking tab is engaged to the leg member to maintain the leg member in an extended state and an unlocked state where the locking tab is disengaged from the leg member allowing the leg member to pivot toward a folded state.

2. The foldable bath tub according to claim 1, when in the extended condition, a distance from an upper edge of the base to the at least portion of each of the first crease and the second crease increases along the length direction of the bath tub from the first end of the bath tub to the second end of the bath tub.

3. The foldable bath tub according to claim 1, where in a side view of the bath tub, a deviation of parallel between the first crease and the second crease is less than 5%.

4. The foldable bath tub according to claim 1, when in the extended condition and at the first end of the bath tub an inner surface of the basin wall in the cross-section taken along the length dimension of the bath tub extends a first dimension from an upper edge of the base to one of the first and second creases, and at the second end of the bath tub the inner surface of the basin wall in the cross-section along the length dimension extends a second greater dimension from the upper edge of the base to the one crease of the first and second creases.

5. The foldable bath tub according to claim 1, when in the extended condition, a distance from the base to the at least portion of each of the first crease and the second crease in the height direction increases along the length direction from the first end of the bath tub to the second end of the bath tub.

6. The foldable bath tub according to claim 1, wherein the base includes a bottom wall with an upwardly extending crotch support, the bottom wall includes a drain hole located between the crotch support and one of the first end and the second end of the bath tub.

7. The foldable bath tub according to claim 1, wherein the engaging member includes a button part movably received in another opening in the leg member.

8. The foldable bath tub according to claim 1, wherein the support assembly includes a mount secured to the rim, and the leg member is pivotally connected to the mount.

9. The foldable bath tub according to claim 8, wherein the mount defines a cavity sized to receive an upper end portion of the leg member.

10. The foldable bath tub according to claim 8, wherein the support assembly includes a backing member connected to the mount, and the engaging member is movably supported on the backing member.

11. The foldable bath tub according to claim 10, further including a spring for biasing the engaging member toward the locked state, the spring is secured by the backing member.

12. The foldable bath tub according to claim 8, wherein the locking tab is movably received in an opening in the mount.

13. A foldable bath tub comprising:

a base;

a rim;

a basin wall disposed between and interconnecting the base and the rim and including first and second creases which extend approximately parallel to one another around the basin wall, the basin wall configured to be positioned in one of a folded condition in which the basin wall is folded into itself at each of the first and second creases an extended condition in which the basin wall is configured to receive an associated child, when in the extended condition a distance from the base to at least a portion of at least one of the first crease and the second crease in a height direction that is perpendicular to the length direction of the bath tub increases along a length direction of the bath tub from a first end of the bath tub to a second end of the bath tub, when in the extended condition, at the first end of the bath tub an inner surface of the basin wall in the cross-section taken along a length dimension of the bath tub extends a first distance from the base to the rim and at the second end of the bath tub the inner surface of the basin wall in the cross-section taken along the length dimension of the bath tub extends a second greater distance from the base to the rim; and a support assembly for supporting the bath tub on an associated subjacent surface, the support assembly including:

a leg member pivotally connected to the rim, and an engaging member connected to the leg member, the engaging member is movable between a locked state to maintain the leg member in an extended state and an unlocked state allowing the leg member to pivot toward a folded state, wherein the support assembly includes a mount secured to the rim, the leg member is pivotally connected to the mount, wherein the engaging member includes a locking tab movably received in an opening in the leg member and a slot in the mount.

14. The foldable bath tub according to claim 13, when in the extended condition and at the first end of the bath tub an inner surface of the basin wall in a cross-section taken along a length dimension of the bath tub extends a first dimension from an upper edge of the base to the one of the first and second creases, and at the second end of the bath tub the inner surface of the basin wall in the cross-section extends a second greater dimension from the upper edge of the base to the one of the first and second creases.

15. The foldable bath tub according to claim 13, wherein the support assembly includes a backing member, and the engaging member is movably supported on the backing member.

16. The foldable bath tub according to claim 15, wherein the backing member is connected to the mount.

17. The foldable bath tub according to claim 13, where in the locked state the locking tab is engaged to the leg member to maintain the leg member in the extended state and in the unlocked state the locking tab is disengaged from the leg member allowing the leg member to pivot toward the folded state.

* * * * *